United States Patent [19]

Dietch

[11] Patent Number: 4,745,329

[45] Date of Patent: May 17, 1988

[54] FRONT ASSEMBLY FOR AN ULTRA-HIGH RESOLUTION COLOR CATHODE RAY TUBE HAVING AN IMPROVED SHADOW MASK COMPENSATED FOR DIFFRACTION AND PROCESS THEREFOR

[75] Inventor: Leonard Dietch, Skokie, Ill.

[73] Assignee: Zenith Electronics Corporation, Glenview, Ill.

[21] Appl. No.: 875,123

[22] Filed: Jun. 17, 1986

[51] Int. Cl.[4] ..... H01J 29/07; H01J 29/32; H01J 9/227

[52] U.S. Cl. ..... 313/402; 313/403; 313/408; 427/68; 445/11; 445/12

[58] Field of Search ..... 313/402, 403, 407, 408; 427/68; 445/11, 12, 24, 30

[56] References Cited

U.S. PATENT DOCUMENTS 2,947,899 8/1960 Kaplan ..... 313/92
4,139,797 2/1979 Rowe ..... 313/408

FOREIGN PATENT DOCUMENTS 132641 8/1982 Japan ..... 313/402

*Primary Examiner*—David K. Moore
*Assistant Examiner*—K. Wieder

[57] ABSTRACT

A color cathode ray tube is disclosed having a front assembly with a shadow mask characterized by having circular apertures at the mask center, and apertures at least in the mask periphery increasingly elongated radially outwardly as a function of distance from the center. The elongation of the apertures is effective to reduce or eliminate the distortion of the deposits on the mask periphery produced by diffraction effects during photoscreening, and to form phosphor deposits compatible in size and shape with the electron beamlets. The screen of the tube according to the invention may have circular or near-circular phosphor deposits thereon. Tube types to which the invention can be applied include the conventional curved-screen/curved-mask tube, and the substantially flat faceplate tube that has a foil shadow mask suspended in tension a predetermined distance from the screening surface. A method is also disclosed for use in the photo-fabrication of a faceplate for an ultra-high resolution color cathode ray tube.

12 Claims, 5 Drawing Sheets

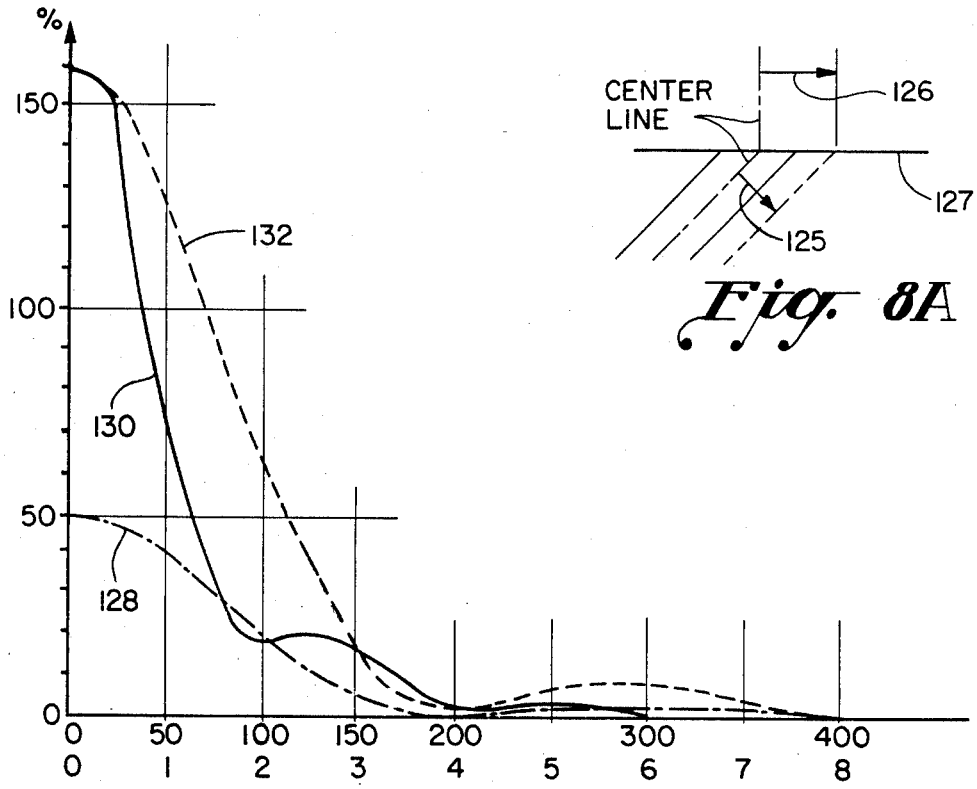
Fig. 8A
Fig. 8
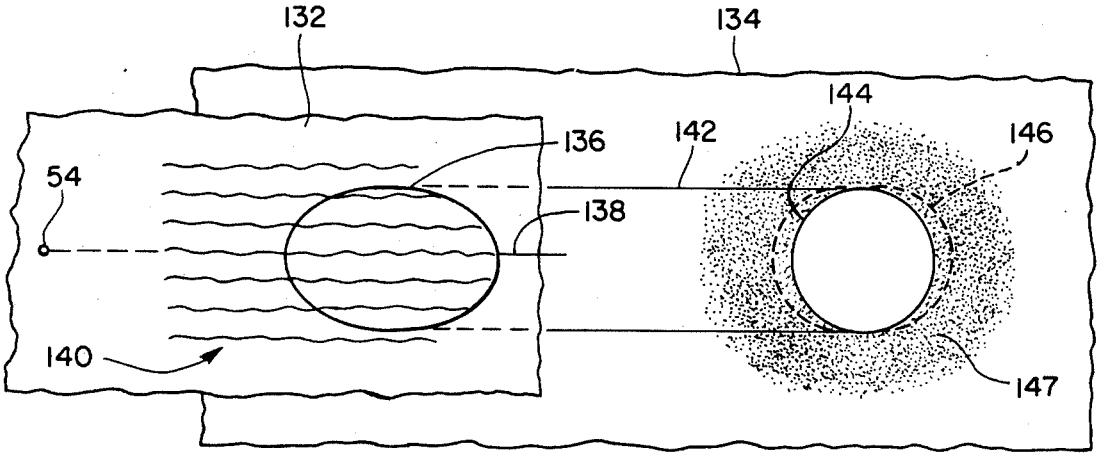
Fig. 9

FRONT ASSEMBLY FOR AN ULTRA-HIGH RESOLUTION COLOR CATHODE RAY TUBE HAVING AN IMPROVED SHADOW MASK COMPENSATED FOR DIFFRACTION AND PROCESS THEREFOR

CROSS-REFERENCE TO RELATED APPLICATIONS AND PATENTS

This application is related to, but is in no way dependent upon, applications Ser. No. 572,089 filed Jan. 18, 1984 now U.S. Pat. No. 4,595,857; Ser. No. 729,015 filed May 17, 1985, now U.S. Pat. No. 4,686,415; Ser. No. 727,486 filed Apr. 26, 1985, now U.S. Pat. No. 4,695,523; Ser. No. 758,174 filed July 23, 1985, now U.S. Pat. No. 4,713,034; Ser. No. 831,697 filed Feb. 21, 1986 now U.S. Pat. No. 4,692,660; Ser. No. 831,696 filed Feb. 21, 1986, now U.S. Pat. No. 4,721,488; Ser. No. 832,493 filed Feb. 21, 1986, now U.S. Pat. No. 4,730,143; Ser. No. 832,556 filed Feb. 21, 1986 now U.S. Pat. No. 4,695,761; Ser. No. 866,030 filed May 21, 1986, Ser. No. 843,890 filed Mar. 25, 1986; and U.S. Pat. Nos. 4,547,696 and 4,591,344, all of common ownership herewith.

This specification includes an account of the background of the invention, the best mode presently contemplated for carrying out the invention, and appended claims.

BACKGROUND OF THE INVENTION

1. Field of the Invention

This invention concerns ultra-high resolution foil tension mask color cathode ray tubes, and more particularly, relates to an improved front assembly for such tubes which has a shadow mask with aperture configurations that provide for brightness uniformity and color purity throughout the picture area.

2. Definitions

The following definitions are essential to an understanding of the present invention:

As used herein, the term "shadow mask" is a component of a color cathode ray tube located in spaced adjacency to the faceplate, one having a plurality of apertures for the passage of the electron beams that excite phosphors deposited on the screen of the faceplate. The shadow mask, noted as having circular or near-circular apertures, "shadows" the triads of phosphor deposits so that the proper beam falls upon the assigned ones of the phosphor deposits. The shadow mask is also referred to as a "color selection electrode", or "parallax barrier." Shadow masks that may benefit from the invention include the foil mask secured to a suitable mask support under high tension, as well as the conventional curved mask with its associated curved faceplate, as designed for ultra-high resolution.

As used herein, "beamlet" means that portion of a light beam, or an electron beam, upon passing through a mask aperture. A "light beamlet" is formed by ultraviolet light rays that irradiate the shadow mask during screening. An "electron beamlet" is formed by any one of the three electron beams which have their origin in a three-beam electron gun located in the neck of the cathode ray tube envelope.

As used herein, the term "light image" is that area of the screening surface upon which a light beamlet falls. A "beam spot" is the area upon which an electron beamlet falls.

As used herein, the term "screening surface" refers to the screening surface of the faceplate which, in the manufacturing process, receives successive layers of screening fluids, comprising the grille and the phosphor deposits. The term "screen" refers to the inner surface of the faceplate following the deposition of the grille and the respective phosphor deposits that emit red, green and blue light when excited to luminescence by electron beamlets.

As used herein, the term "negative guard band" means a condition in which the beam spots are larger than the target phosphor deposits by a predetermined guard band area. In negative guardband screens, the margin of safety, or "guard band" that prevents color impurities, conventionally comprises a light-absorbing material called the grille.

As used herein, the term "clipping" refers to the reduction in the radial width of a beamlet in passing through a shadow mask aperture at an angle, and in which the edges of the aperture intercept the light rays in photoscreening, or the electron beams during tube operation. The amount of clipping is a function of the thickness of the shadow mask and the angle at which the light rays or electrons approach the aperture. The thicker the mask and the greater the angle, the greater the clipping.

3. Prior Art

The following examples are being submitted to the Patent and Trademark Office for evaluation as to possible relevance to the claimed subject matter. The examples are believed to be the closest of the art of which applicant is aware, but applicant makes no admission as to its relevance in fact, to its legal sufficiency, or to its priority in time, nor does applicant represent that no better art exists. U.S. Pat. No. 2,947,899 to Kaplan. A compensated aperture mask structure is disclosed having a plurality of apertures which are round at the axial aperture, but distorted into an elliptical configuration by radial foreshortening as a function of the distance of the apertures from the axial aperture. U.S. Pat. No. 4,139,797. A system is disclosed for increasing tolerance to radial registration errors between the electron beam landing areas and the phosphor elements due to shadow mask doming during operation of the tube. The geometry of the beam landing areas and the phosphor elements are characterized by having off the tube axis smaller ones of the phosphor elements and the mask apertures radially compressed relative to larger ones without a corresponding azimuthal compression. The radial compression increases with increasing radius such that the tolerances in the radial direction increase off axis without a corresponding increase in azimuthal tolerance. The result is said to be increased tolerance to the doming-induced registration errors between the phosphor elements and the beam landing areas.

OBJECTS OF THE INVENTION

It is an object of the invention to provide a ultra-high resolution color cathode ray tube in which the phosphor deposits on the screen, and the beam spots, are compatible in size and shape all over the screen.

It is another object of the invention to provide a front assembly for ultra-high resolution color cathode ray tubes having a shadow mask which, when used for photoscreening in conjunction with the screening surface of the faceplate, forms phosphor deposits compatible in size and shape with the beam spots, especially on the periphery of the screen.

It is a further object of the invention to provide a front assembly for ultra-high resolution color cathode ray tubes having a shadow mask aperture configuration that provides for the elimination of distortion of phosphor deposits when screening tubes having the very small mask apertures required for ultra-high resolution.

It is another object of the invention to overcome the problems in photoscreening ultra-high resolution color cathode ray tubes having large deflection angles and shadow masks with very small apertures.

It is a further object of this invention to provide a method for reducing or eliminating the distortion or phosphor deposits on the periphery of the screen when photoscreening ultra-high resolution color cathode ray tubes.

BRIEF DESCRIPTION OF THE DRAWINGS

FIG. 8 is graph showing the effect of diffraction of ultraviolet light by slits corresponding to the two different light beamlet widths shown by FIGS. 7A and 7B; FIG. 8A shows diagrammatically the units used on the horizontal axis in FIG. 8;

FIG. 9 is a view similar to FIG. 6A, depicting the beneficial effect of a shadow mask according to the invention on the configuration of the light image and the resulting phosphor deposit;

DESCRIPTION OF THE PREFERRED EMBODIMENT

Figure 1:
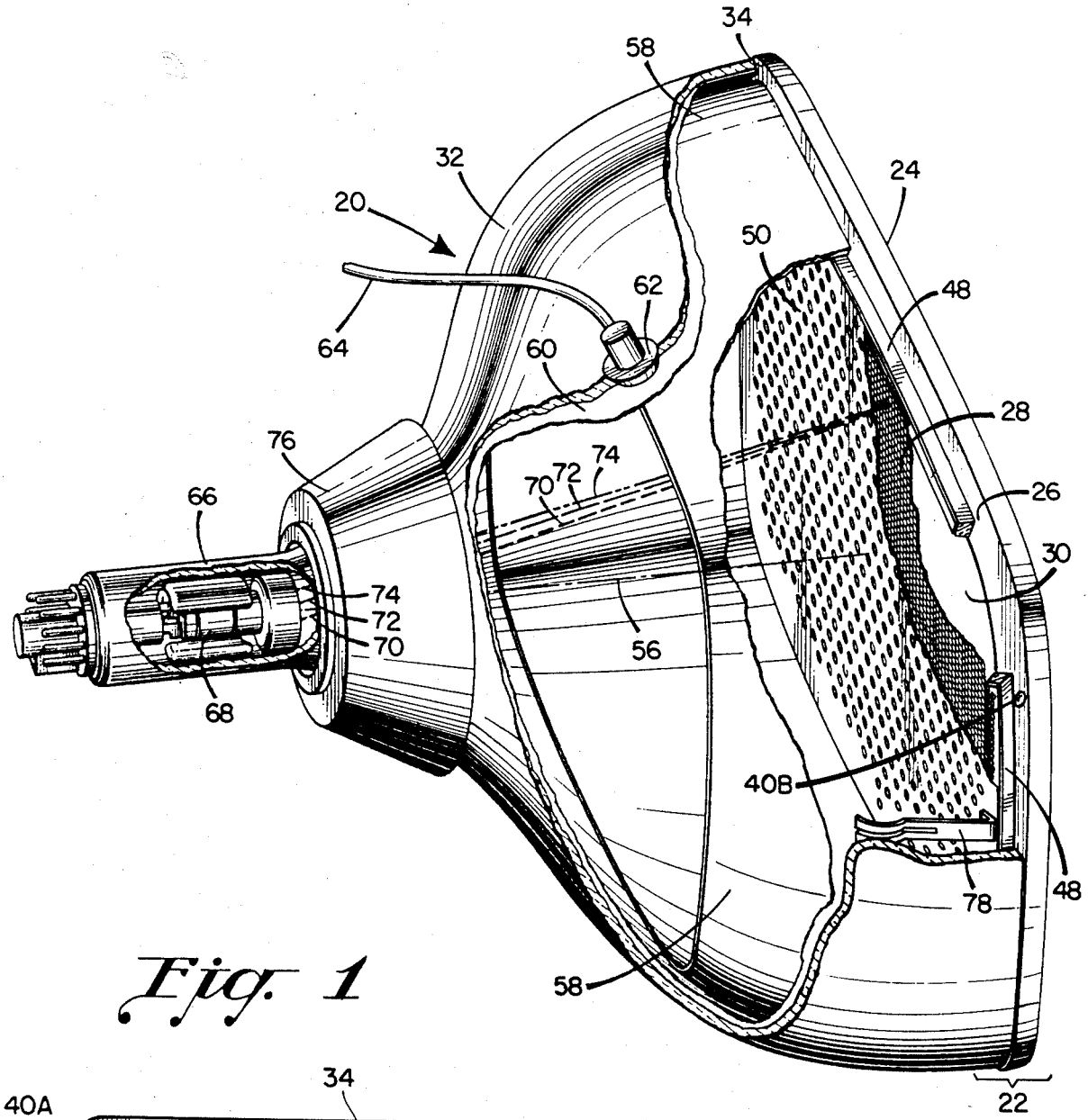
FIG. 1 is a side view in perspective of a color cathode ray tube having a front assembly with a shadow mask indicated as being a tension foil mask, with cut-away sections that indicate the location and relation of the mask to other major tube components.

The components of the invention are disclosed in the drawings and are identified and described in the following paragraphs in this sequence: reference number, a reference name, and a brief description of structure, interconnections, relationship, functions, operation, and/or result, as appropriate.

Figure 2:
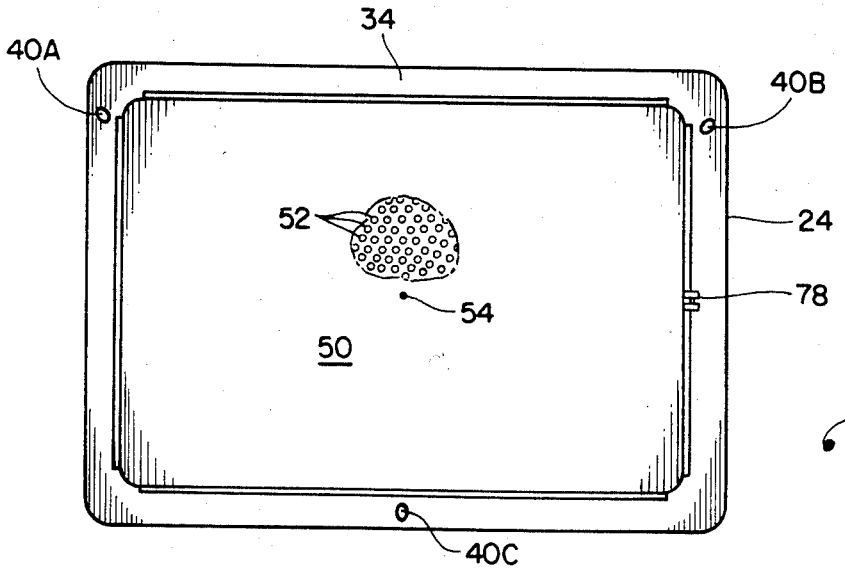
FIG. 2 is a plan view of the front assembly of the tube of FIG. 1, showing further details of the relationship of the shadow mask with the faceplate; the enlarged inset indicates the circular contour of the apertures in the central area of the mask.
Figure 3:
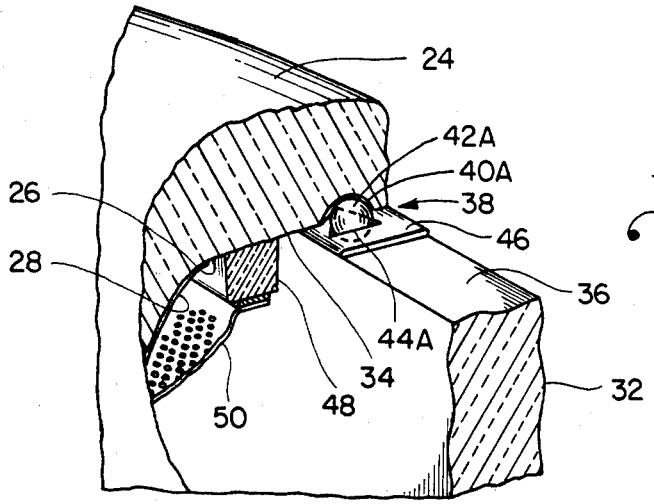
FIG. 3 is a view in elevation of a section of the tube front assembly depicted in FIGS. 1 and 2, showing in greater detail the location and orientation of a tensioned foil shadow mask with respect to the faceplate and the funnel following its installation in a cathode ray tube.

(With initial reference to FIGS. 1, 2 and 3)

20 color cathode ray tube
22 front assembly
24 faceplate
26 faceplate-to-funnel sealing area
28 centrally disposed phosphor screen
30 film of reflective and electrically conductive aluminum
32 funnel
34 peripheral sealing area of faceplate, adapted to mate with a funnel
36 funnel-to-faceplate sealing area
38 indexing means, having these components:
  40A, 40B, 40C: V-grooves
  42A, 42B, 42C: ball means
  44A, 44B, 44C: cavities
46 layer of frit
48 separate shadow mask support structure (The shadow mask support structure depicted in FIGS. 1–4 is fully described and claimed in referent copending application Ser. No. 866,030.

50 a foil shadow mask suspended in tension
52 shadow mask apertures near center of mask, depicted in the enlarged inset as being circular apertures
54 center of mask
56 anterior-posterior axis of tube
58 internal magnetic shield ("IMS")
60 internal conductive coating in funnel
62 anode button
64 high-voltage conductor
66 neck of tube
68 in-line electron gun; provides three discrete in-line electron beams for exciting the triads of phosphors deposited on the screen 28
70, 72, 74 electron beams; for activating respective red-light-emitting, green-light emitting, and blue-light-emitting phosphor deposits on the screen 28
76 yoke; causes beams 70, 72 and 74 to traverse across screen 28
78 contact spring; provides an electrical path between the IMS 58 and the shadow mask support structure 48.

DESCRIPTION OF THE INVENTION

In the process of making the phosphor screen of a color tube, a black "grille" is initially deposited on the screening surface of the faceplate. A coating of a photosensitive material such as dichromated PVA (polyvinyl alcohol) is first deposited on the screening surface. The coating is then exposed to a light pattern through the shadow mask, which has been mounted a specified distance from the screening surface. The coating is developed to yield a pattern of dots whose distribution, size and shape correspond to the distribution, size and shape of the apertures in the shadow mask. After development of the PVA coating, the inner surface is covered with a layer of a light-absorptive material such as a slurry of graphite. The slurry is dried and becomes adherent. The remaining PVA deposits and the graphite overlying them are then stripped away by a chemical agent such as hydrogen peroxide. What remains is a black "grille" with openings in which the red, green and blue light-emitting phosphors are successively deposited.

Figure 4:
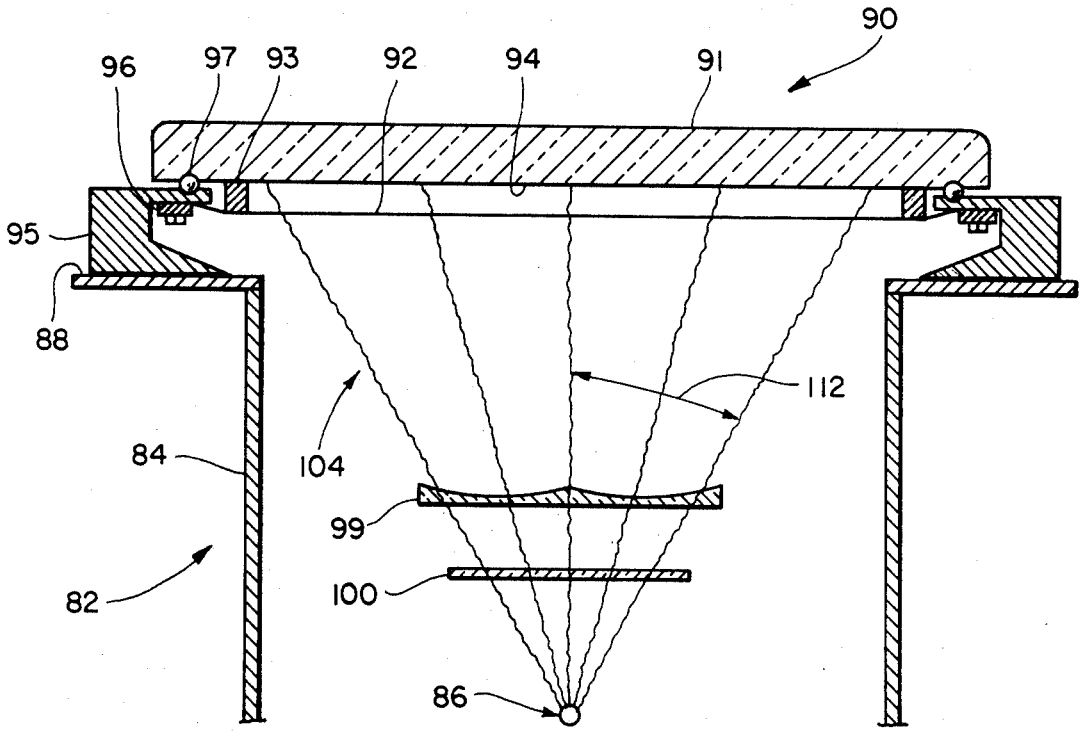
FIG. 4 is a sectional side-elevational view, shown schematically, of a "lighthouse" used for photoscreening the front assembly of color cathode ray tubes having the tension foil shadow mask.

The photoscreening apparatus is termed a "lighthouse"; a typical lighthouse 82 is depicted in FIG. 4. Lighthouse 82 is illustrated schematically as comprising a base 84 within which is contained a light source 86 of UV (ultraviolet) radiation, which is generated by a fine bare arc, typically an approximate point source when used for screening with shadow masks having circular apertures. Lighthouse 82 includes a table assembly 88 for receiving a screening assembly 90, which comprises a faceplate 91, a shadow mask 92 and a shadow mask support structure 93, which supports and retains mask 92 a predetermined distance from the screening surface 94 of the faceplate 91. Shadow mask 92 is depicted as being clamped by mask-stretching fixture 95, which exerts tension on the mask 92. The borders of the mask are shown as being clamped by clamping means 96. The faceplate 91 and the mask stetching fixture 95 are indicated as being held in precise registry by ball-and-groove indexing means 97 similar in form and function to the indexing means 38 described previously in connection with FIGS. 1–3. The screening assembly 90 is assembled and disassembled four times in the process of photoscreening the grille and the phosphor dots on the screening surface 94. The screening surface 94 receives the various screening fluids following successive exposures to ultraviolet radiation. The light rays 104 from point source 86 are depicted as irradiating the screening surface 94 after passing through a correction lens 99, a neutral density filter 100, and the apertures of the shadow mask 92. Upon completion of the photoscreening, the shadow mask 92, still under tension, is permanently secured to the support structure 93 as by welding, and the remainder of the mask is cut away to release the screening assembly 90, which now becomes the front assembly, and to free the mask stretching fixture 95 for further use.

Figure 5:
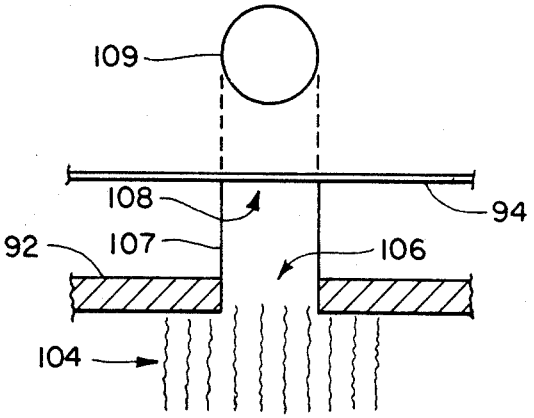
FIG. 5 is a diagrammatic view in elevation of the formation of a light beamlet near the center of a shadow mask, with a projection showing the rotationally symmetrical configuration of the resulting light image on the screening surface of the faceplate due to its location near the center.

With reference to FIG. 5, during exposure of the screening surface 94 in the lighthouse, the light rays 104 from the point source 86 of the lighthouse 82, in passing through the apertures of the shadow mask 92, approach the screening surface 94 more or less perpendicularly near the center of the mask 92. By way of example, light rays 104 are shown as passing through a circular aperture 106 of the shadow mask 92 to form a light beamlet 107 which in turn forms a light image 108 on screening surface 94. The light image 108 on screening surface 94 is shown by the projection 109 of the light image 108 as being a round dot consonant in size and shape with the circular shadow mask aperture 106.

Figure 6:
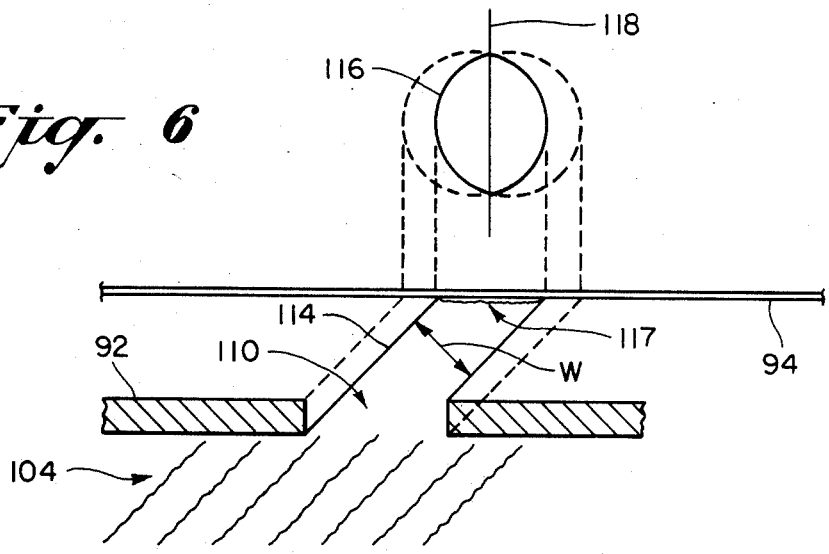
FIG. 6 is a view similar to FIG. 5 except that a light image distorted by clipping is depicted as being formed on the screening surface due to its location on the periphery of a shadow mask.

On the periphery of the screening surface 94, however, the light rays 104 arrive at an angle of about 45 degrees or more in flat tension mask tubes having a wide deflection angle; this angle (not to scale) is indicated by reference number 112 in FIG. 4. This condition is depicted in FIG. 6 wherein light rays 104 are shown as passing through an aperture 110 to form light beamlet 114. A projection 116 of the light image 117 formed by light beamlet 114 on the screening surface 94 shows that the light image 117 is in the form of an oval, with its major axis 118 tangential. The oval shape is the result of the thickness of the mask 92 which "clips" the light rays 104, as indicated by the dashed lines lateral to and on either side of light beamlet 114.

Figure 6A:
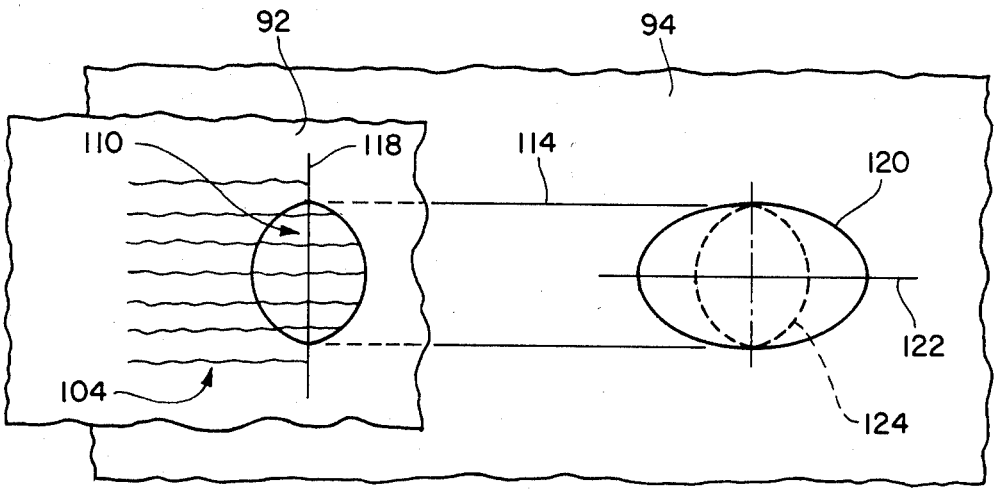
FIG. 6A is a diagrammatic plan view of the elements of FIG. 6 showing a peripheral section of the shadow mask superimposed in registry over a section of the associated screening surface, and depicting the influence of diffraction at a mask aperture on the contour of the resulting phosphor deposit.

One would expect the phosphor dot formed on the screening surface 94 by the photoscreening process to be in conformance with the oval shape shown by projection 116; that is, with its major axis 118 tangential. Unexpectedly, this is not the case, as the major axis of the oval formed on the screening surface actually lies on a radial vector, instead of being tangential. This surprising effect is shown highly schematically by FIG. 6A wherein a section of the shadow mask 92 is seen in a plan view, with a section of the screening surface 94 beneath it. Aperture 110 is indicated as the light rays 104 "see" it; that is, as being an oval whose major axis 118 is tangential. It will be observed that the light beamlet 114, formed in passing through aperture 110, does not define on screening surface 94 a true light image of the oval aperture 110 "seen" by light rays 104, but rather a light image 120 comprising an elongated oval whose major axis 122 lies in a radial direction with respect to the center of the mask.

On the other hand, an electron beamlet when passing through aperture 110, will produce an exact image of the aperture 110 on the screening surface 94 as indicated by the beam spot 124 comprising a dashed-line oval, shown as being superimposed on oval pattern 120. The beam spot formed by the electron beamlet is distorted only by clipping. This lack of conformance of the untrue light image 120 formed by light beamlet 114, and the truer image 124 formed by an electron beamlet, is intolerable in terms of effective shadow mask function. The undesirable effects include underexposure of the corner regions of the screen and placement of phosphors where there should be grille, leading to reduced contrast, or even overlapping of the phosphors, which in turn can cause color impurities.

The undesired effect is attributable to the physical characteristics of shadow masks designed for use in ultra-high resolution displays. The foil tension mask described heretofore is a good example of such a mask. In such masks, the apertures may be spaced, e.g., 8 mils apart center-to-center, and their diameter may be 3 mils. The mask may be 1 mil in thickness. The spacing (the "Q-distance") between mask and screen is typically 200 mils. In screens made with this geometry, it has been shown that while the phosphor dots in the central region of the screen are circles of 3 mil diameter, the phosphor dots formed near the corners are, as has been noted, oval-shaped the wrong way; that is, the major axis of the oval is radial instead of tangential, as shown by light image 120 in FIG. 6A.

This unexpected and detrimental effect is caused by diffraction of the ultraviolet light used in the screening process. The cause of the radial distortion is attributable to the fact that the aperture 110 shown by FIG. 6, indicated as appearing as an oval by projection 116, in actuality acts as a "slit" to produce an undesired distortion of the beam spot. A narrow slit, when illuminated by collimated light, produces a diffraction pattern which widens as the slit is narrowed. This phenomenon, known as Fraunhofer diffraction, occurs with light of a given wavelength $\lambda$ whenever the number of wavelengths contained in the distance "D" between the diffracting aperture and the screening surface exceeds the square of the number of wavelengths contained in the transverse dimension "A" of the diffracting aperture:

$$D/\lambda > (A/\lambda)^2$$

The region so defined is known as the far field.

(Note: $\lambda = 3600$ Å $= 14$ microinches.)

Diffraction effects also occur in the near field. These effects are characterized by the opposite relationship, $$D/\lambda < (A/\lambda)^2$$

These effects are known as Fresnel diffraction. They are more subtle and involve primarily a redistribution of light within the region that would normally be illuminated, with little light falling into the region which would normally be in shadow.

Because the square of the aperture dimension "A" enters into the above equations, a relatively minor change in "A" can cause a transition from far field to near field conditions, with profound consequences. This happens to be the situation in the case of the ultra-high resolution tube described in the foregoing paragraphs.

A complete computation of the diffraction pattern produced by the circular apertures in the peripheral regions of the shadow mask would be quite lengthy. A useful approximation consists in replacing the circular aperture by a long slit of equal width, with its axis positioned tangentially with respect to the center of the faceplate. The diffraction patterns produced by slits can be calculated by standard methods: see for instance the book *Introduction to Geometrical and Physical Optics,* by Joseph Morgan, page 277 and appendix 1E.

Figure 7A:
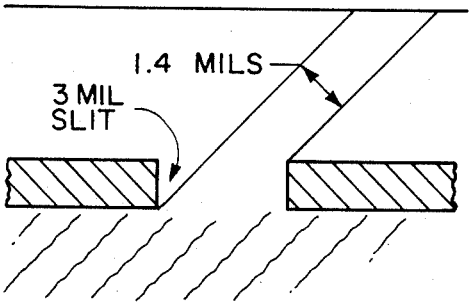
FIGS. 7A and 7B are diagrammatic views in elevation showing the narrowing of light beamlets passing through apertures of two different widths.
Figure 7B:
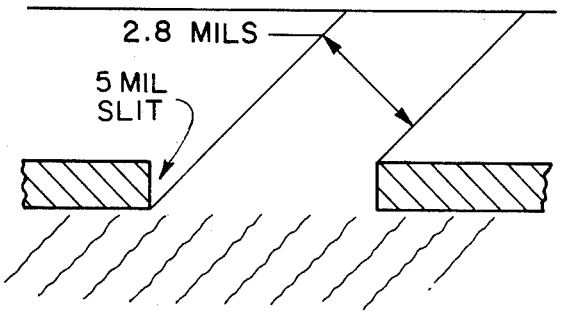

The diffraction of ultraviolet light by tangential slits, as related to the present disclosure, is discussed in the following with reference to FIGS. 7A, 7B and 8. As shown by FIGS. 7A and 7B, the calculations were carried out for a slit 3 mils wide and another slit 5 mils wide, both in a mask of 1 mil thickness. The angle of incidence of the collimated light, (indicated schematically by the wavy lines) was assumed to be 45 degrees, with a wavelength of 0.36 micrometers. Because of the 45 degree angle, the length of the trajectory from slit to screen increases from 200 mils (the normal Q-distance) to 283 mils (the "slant" distance.) As explained previously, the 45 degree angle of incidence causes clipping proportional to the mask thickness, which narrows the light beamlet radially; in addition, the effective radial width of the light beamlet ("W" in FIG. 6), is reduced by the cosine of the angle of incidence, so that the light beamlet which finally emerges from the 3 mil aperture is only 1.4 mils wide, as indicated by FIG. 7A. Similarly, as shown by FIG. 7B, the light beamlet emerging from a 5 mil aperture is only 2.8 mils wide.

The curves of FIG. 8 represent the light intensity distribution to the right of the center line of the projected pattern. The distribution is symmetrical, therefore only one side is plotted. The vertical scale indicates light intensity in terms of percent of that intensity which would exist if the aperture were very large. With reference also to FIG. 8A, the upper horizontal scale gives the distance 125 from the center across the light beamlet measured in wavelengths of light. The lower horizontal scale provides the the distance 126 from the center projected on the screening surface 127 in mils.

The dash-dot curve 128 corresponds to the narrow, 3 mil slit shown by FIG. 7A, and represents actual intensity. It will be seen that the intensity at the center is nearly 50 percent; the distance between half power points is 3.6 mils, more than the original width of the slit and much wider than the light beamlet that actually passes through the slit. The distance between the two points where the intensity is ten percent of the peak is nearly 6 mils.

The solid line curve 130 represents the wide slit shown in FIG. 7B. Here, the intensity at the center is much higher—60 percent higher than the unperturbed intensity would be—and it drops to half its peak value at a point only 0.9 mils from the center line, giving a distance of 1.8 mils between halfpower points. Remember that the slit is now 5 mils wide, and even the tilted light beamlet emerging from the slit is nearly 3 mils wide. Clearly, diffraction in this case has made the light beamlet considerably narrower than the slit, while in the first case it made it much wider.

The difference between the two slits is further illustrated by a comparison of solid curve 130 with the dashed curve 132. Here, the intensity represented by the curve 128 (narrow slit) has been multiplied by an appropriate factor (about 3.2) to make the two peak amplitudes equal. It is evident that the light image produced by the narrow slit (curve 132) is almost twice as wide as the light image produced by the wide slit (curve 130).

The unexpected problem presented by the diffraction of ultraviolet light in radially foreshortened apertures located in the mask periphery is resolved by the inventive means set forth herein. The shadow mask for the front assembly of an ultra-high resolution color cathode ray tube according to the invention is characterized by having apertures circular at the mask center, and apertures at least in the mask periphery increasingly elongated radially outwardly as a function of distance from the center. This configuration is depicted in part in FIG. 9 wherein a peripheral section of a shadow mask 132 according to the invention is indicated as being superimposed over a screening surface 134. Shadow mask 132 is shown as having an aperture 136 indicated as being elongated according to the invention with the major axis 138 of the elongation represented as being radially aligned; that is, aligned with a line extending from the mask center 54. In other words, the radial length of the aperture is greater than the tangential width to compensate for diffraction effects in the photoscreening process. Rays of ultraviolet light 140 are represented as passing through aperture 136, producing a light beamlet 142 which forms a near-circular image 144, and consequently, forms a round phosphor deposit on screening surface 134.

By virtue of the apertures at least in mask peripheral areas being increasingly elongated radially outwardly as a function of distance from the center according to the invention, UV-diffraction effects distortive to the phosphor deposits on the periphery of the screening surface during photoscreening are overcome. The elongation of the apertures according to the invention is effective to diminish the distortion of the deposits on the periphery and form deposits compatible in size and shape with the electron beamlets. This compatibility is indicated by FIG. 9 wherein light image 144 (and the consequent phosphor deposit) is depicted as being compatible in size and shape with the beam spot 146, which is indicated by the dashed outline image of beam spot 146. Beam spot 146 will be noted as being slightly elongated in a radial direction; however, its contour will be seen as being compatible with the light image 144 (and the resulting phosphor deposit). The fact that the beam spot 146 does not exactly represent the contour of the aperture though which it passes is due to the aforedescribed "clipping" effect. A light-absorbing material 147, is indicated diagrammatically by the stipple pattern around light image 144.

Further with reference to FIG. 9, a beneficial effect of the invention becomes readily apparent, in that the ultraviolet rays used in screening, in passing through an aperture 136 radially elongated according to the invention, overcome the diffraction effects to produce a near-circular light image landing 144, and hence will form a near-circular phosphor deposit, despite the clipping of the rays. Yet the electron beamlet itself, noted as projecting a truer image of the aperture through which it passes, is clipped sufficiently so as to produce a beam spot 146 which is only slightly oval and fully compatible with the light image 144 and the phosphor deposit formed in photoscreening.

Figure 10:
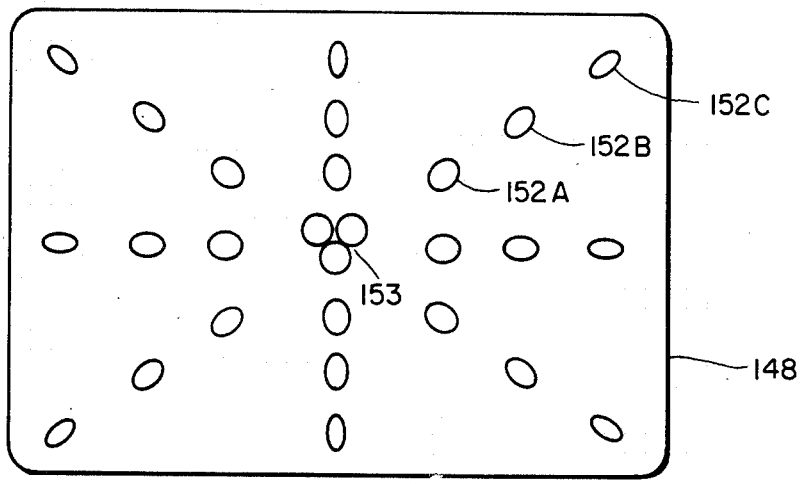
FIG. 10 is a plan view of a shadow mask representing diagrammatically the distribution and contours of the mask apertures according to the invention; and, FIG. 11 is a perspective view partly cut away to show details of a color cathode ray tube having a curved faceplate and an associated curved shadow mask with apertures shaped according to the invention.

The location and contour of the apertures according to the invention are depicted highly schematically in FIG. 10 by the plan view of a shadow mask 148. It will be noted that apertures 152A, 152B and 152C at least in mask peripheral areas are depicted as being increasingly elongated radially outwardly as a function of the distance from mask center 153.

Diffraction effects are, of course, not limited to the radial dimension; they also occur along the tangential dimension of the mask apertures. However, the tangential dimension is not foreshortened either by clipping or by the cosine of the angle of incidence; therefore diffraction effects along the tangential axis are generally small and do not require the type of correction provided by the present invention. In the figures, particularly FIGS. 6A and 9, the tangential diffraction is neglected.

A process or method according to the invention for use in the manufacture of an ultra-high resolution color cathode ray tube, and the photo-fabrication of the substantially flat faceplate of such a tube, comprises the following. (Components of the process are shown by FIG. 4.) The tube may have a wide deflection angle. The process provides for photo-screening phosphor deposits on the screening surface (94) of the faceplate (91) that are compatible in size and shape with the electron beam spots impinging the deposits. A phosphor compound sensitive to ultraviolet light is applied to the screening surface (94). A foil shadow mask (92) is a provided that has apertures of such small dimension as to produce noticeable diffraction of ultraviolet light on the peripheral areas of the mask. The mask (92) has circular apertures at the mask center, and apertures at least in the mask periphery increasingly elongated radially outwardly as a function of distance from the mask center. The mask is suspended in tension at a predetermined distance from the screening surface (94), and the screening surface is exposed to ultraviolet light. The phosphor compound is developed to produce the phosphor deposits. The elongation of the apertures according to the inventive process is effective to reduce or eliminate ultraviolet light diffraction effects, and form phosphor deposits compatible in size and shape with the beam spots.

Figure 11:
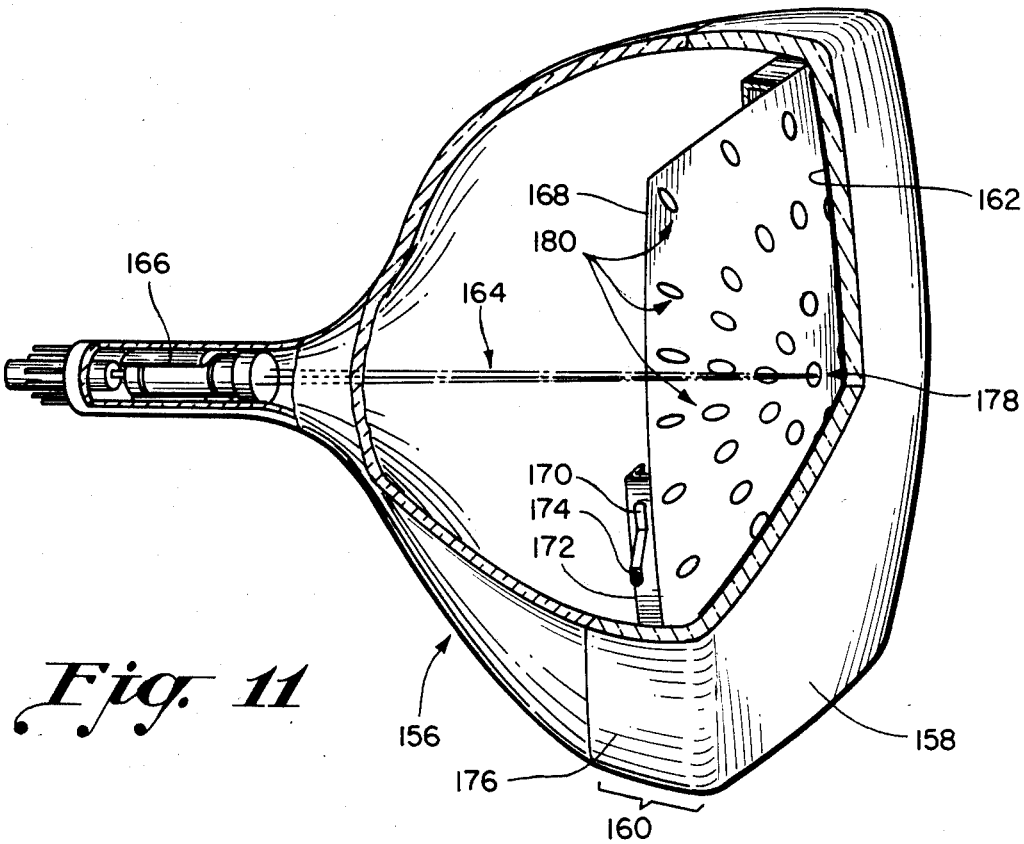

While a particular embodiment of the invention has been shown and described, it will be readily apparent to those skilled in the art that changes and modifications may be made in the inventive means without departing from the invention in its broader aspects. For example, the invention is applicable to the color cathode ray tube 156 depicted in FIG. 11, which will be readily recognized as the type having a conventional curved faceplate 158. Faceplate 158 of the front assembly 160 has a screening surface 162 for receiving deposits of phosphor (not indicated) that are excitable to luminescence by electron beamlets which have their origin in three electron beams 164 projected by electron gun 166. The deposits of phosphor are deposited by photoscreening with UV light. The front assembly includes a curved shadow mask 168 indicated as being suspended a predetermined distance from screening surface 162. The means of suspension 158 of shadow mask 168 may be by three springs selectively spaced about the periphery of the mask; one of the springs, spring 170 (representative of all three springs), is shown as being attached to the rigid frame 172 that supports shadow mask 168. An aperture 174 in an extension from spring 170 is engaged by a stud (not shown) that projects from the inner surface of the skirt 176 of tube 156. Shadow mask 168 is indicated highly schematically as having, according to the invention, circular apertures at the mask center 178, and apertures at least in peripheral areas 180 of mask 168, which will be noted as being elongated radially outwardly as a function of distance from the center 178. It is observed that tube 156 is to be considered an ultra-high resolution tube in that it has apertures of a small diameter effective to produce the desired high resolution; that is, aperture diameters of about 3 mils. Such small aperture diameters, which are about half the diameter of the apertures of a standard curved screen/-curved mask tube, are noted as being susceptible to UV-diffraction effects distortive to the phosphor deposits in peripheral areas—effects resolved by the present invention. As has been noted, the undesired UV-diffraction effect is also aggravated by a wide deflection angle.

The benefits of the invention can also be extended to a type of color cathode ray tube known as the "flat-square" tube. The type of tube has a faceplate that is relatively flat, with square corners. The correlatively flat shadow mask does not have the inherent strength of the curved mask of the tube shown by FIG. 11; in consequence, the mask must be made much thicker—of the order of 12 mils, by way of example. To achieve high resolution, the apertures must be small. The relatively thick shadow mask may then be susceptible, at least on peripheral areas of the screening surface, to the UV-diffraction effects described in this disclosure in that the thickness of the metal of the mask, and the small aperture diameter required for ultra-high resolution, results in greater beam clipping. Clipping in turn causes the apertures in the periphery of the mask to appear as slits to the ultraviolet light rays in photoscreening, which, as has been described, produce the UV-diffraction effects distortive to the the phosphor deposits.

The aim of the appended claims is to cover all such changes and modifications as fall within the true spirit and scope of the invention.

I claim:

1. For use in a high-resolution color cathode ray tube of the general type having a shadow mask whose apertures are of such diminutive nominal size as to normally elongate the phosphor deposits in peripheral screen areas during phosphor photoscreening as a result of UV-diffraction distortion effects, an improved shadow mask having apertures which are substantially round at the mask center and increasingly elongated radially outwardly as a function of distance from the mask center, such that radial elongation of phosphor deposits in peripheral areas of the screen areas due to UV-diffraction distortion effects during photoscreening is reduced.

2. For use in a high-resolution color cathode ray tube of the general type having a shadow mask whose apertures are of such diminutive nominal size as to normally elongate the phosphor deposits in peripheral screen areas during photoscreening as a result of significant Fraunhofer UV-diffraction distortion effects, an improved shadow mask having apertures substantially round at the mask center and increasingly elongated radially outwardly as a function of distance from the mask center, the radial dimension of said elongated apertures being sufficiently large relative to the UV exposure radiation mean wavelength and the slant distance from the apertures to the screen that radial elongation of phosphor deposits in peripheral areas of the screen due to Fraunhofer diffraction distortion effects during photoscreening is reduced.

3. A front assembly for a use in a color cathode ray tube of the general type having a substantially flat or curved faceplate and a shadow mask whose apertures are of such diminutive nominal size as to normally elongate the phosphor deposits in peripheral screen areas due to significant Fraunhofer UV-diffraction distortion effects during lighthouse exposure, said front assembly having an improved shadow mask with apertures which are substantially round at the mask center and increasingly elongated radially outwardly as a function of distance from the mask center, the radial dimension of said elongated apertures being sufficiently large relative to the UV exposure radiation mean wavelength and the slant distance from the apertures to the screen that Fraunhofer diffraction distortion does not occur during lighthouse exposure, and the radial elongation of phosphor deposits in peripheral areas of the screen due to UV-diffraction distortion effects is significantly reduced.

4. For use in a front assembly for a color cathode ray of the general type having a flat faceplate and a tensed foil shadow mask with apertures of such diminutive nominal size as to normally elongate the phosphor deposits in peripheral screen areas during photoscreening as a result of UV-diffraction distortion effects, an improved shadow mask having apertures substantially round at the mask center and increasingly elongated radially outwardly as a function of distance from the mask center, the radial dimension of said elongated apertures being sufficiently large relative to the UV exposure radiation mean wavelength and the slant distance from the aperture to the screen that Fraunhofer diffraction distortion does not occur in peripheral areas of the screen during lighthouse exposure, and the radial elongation of the resulting phosphor deposits in peripheral areas of the screen during photoscreening is significantly reduced.

5. A front assembly for use in an ultra-high resolution color cathode ray tube having a substantially flat faceplate with a screening surface for receiving deposits of phosphors excitable to luminescence by electron beamlets, said deposits being deposited by photoscreening with UV light, said assembly including a foil shadow mask suspended in tension a predetermined distance from said screening surface, and having apertures of a small diameter effective to produce said ultra-high resolution but susceptible to UV-diffraction effects distortive to said deposits on the periphery of said screening surface during said photoscreening, said shadow mask being characterized by having circular apertures at the mask center, and apertures at least in mask peripheral areas increasingly elongated radially outwardly as a function of distance from the center, whereby the elongation of said apertures is effective to reduce or eliminate the UV-diffraction distortion of the deposits on said peripheral areas and form deposits radially foreshortened relative to the peripheral area apertures compatible in size and shape with said electron beamlets.

6. A front assembly for use in an ultra-high resolution color cathode ray tube having a curved faceplate with a screening surface for receiving deposits of phosphor excitable to luminescence by electron beamlets, said deposits being deposited by photoscreening with UV light, said assembly including a curved shadow mask suspended a predetermined distance from said screening surface and having apertures of a small diameter effective to produce said ultra-high resolution but susceptible to UV-diffraction effects distortive to said deposits on the periphery of said screening surface during said photoscreening, said shadow mask characterized by having circular apertures at the mask center, and apertures at least in mask peripheral areas increasingly elongated radially outwardly as a function of distance from the center, whereby the elongation of said apertures is effective to reduce or eliminate the UV-diffraction distortion of said deposits on the periphery and form deposits radially foreshortened relative to the peripheral area apertures compatible in size and shape with said beamlets.

7. For use in the manufacture of an ultra-high resolution color cathode ray tube having a faceplate with a screening surface for receiving phosphor deposits excitable to luminescence by electron beamlets, and deposited by photoscreening with UV light, a shadow mask detachably suspended a predetermined distance from said screening surface and having apertures of a small diameter effective to produce said ultra-high resolution but susceptible to UV-diffraction effects distortive to said deposits on the periphery of said screening surface during said photoscreening, said mask being characterized by having circular apertures at the mask center, and apertures at least in the mask periphery increasingly elongated radially outwardly as a function of distance from the center, whereby the elongation of said apertures is effective to reduce or eliminate the distortion of the deposits on the screening surface periphery and form deposits compatible in size and shape with said beamlets.

8. For use in the manufacture of an ultra-high resolution color cathode ray tube having a substantially flat faceplate with a screening surface for receiving phosphor deposits excitable to luminescence by electron beamlets, and deposited by photoscreening with UV light, a foil shadow mask detachably suspended in tension a predetermined distance from said screening surface and having apertures of a small diameter effective to produce said ultra-high resolution but susceptible to UV-diffraction effects distortive to said deposits on peripheral areas of said screening surface during said photoscreening, said mask characterized by having circular apertures at the mask center, and apertures at least in the mask periphery increasingly elongated radially outwardly as a function of distance from the center, whereby the elongation of said apertures is effective to reduce or eliminate the distortion of the deposits on the screening surface periphery and form deposits compatible in size and shape with said beamlets.

9. For use in the photo-fabrication of a high-resolution color cathode ray tube of the general type having a shadow mask whose apertures are of such diminutive nominal size as to normally elongate the phosphor deposits in peripheral screen areas during phosphor photoscreening as a result of UV-diffraction distortion effects, a process for photoscreening phosphor deposits on the screening surface of said faceplate, comprising:

applying a phosphor compound sensitive to ultraviolet light to said screening surface;

providing a foil shadow mask having apertures which are substantially round at the mask center and increasingly elongated radially outwardly as a function of distance from the mask center;

suspending said mask in tension a predetermined distance from said screening surface;

exposing said screening surface to ultraviolet light through said apertures to produce a light beam spot on said screening surface and said phosphor compound for each of said apertures;

developing said compound to produce said phosphor deposits;

such that the radial elongation of phosphor deposits in peripheral areas of the screen due to UV-diffraction distortion effects during photoscreening is reduced, and said deposits are compatible in size and shape with said beam spots.

10. A method for use in the manufacture of an ultra-high resolution, wide-deflection-angle color cathode ray tube having a faceplate with a screening surface for receiving deposits of phosphors impinged by electron beam spots and applied by photoscreening with ultraviolet light, said tube being of the general type having a shadow mask whose apertures are of such diminutive nominal size as to normally elongate the phosphor deposits in peripheral screen areas during said photo-fabrication as a result of UV-distraction-distortion effects, the method comprising:

applying a phosphor compound sensitive to ultraviolet light to said screening surface;

providing a foil shadow mask having apertures which are circular at the center of said mask, and at least in the mask periphery, increasing elongated radially outwardly as a function of distance from the mask center, the radial dimension of said elongated apertures being sufficiently large relative to the UV exposure radiation mean wavelength and the slant distance from the apertures to the screen such that Fraunhofer diffraction distortion does not occur during photoscreening;

suspending said mask in tension a predetermined distance from said screening surface;

exposing said screening surface to said ultraviolet light through said apertures to produce an electron beam spot on said screening surface and said phosphor compound for each of said apertures for forming said deposits, and developing said compound to produce said phosphor deposits;

such that the elongation of said apertures is effective to reduce or eliminate UV-diffraction distortion effects on the deposits in said peripheral areas and form phosphor deposits compatible in size and shape with said beam spots, and the elongation of the resulting phosphor deposits is significantly reduced.

11. The method according to claim 10 wherein said faceplate is substantially flat and said mask is a tension mask.

12. The method according to claim 10 wherein said faceplate and said shadow mask are curved.

* * * * *